US009694934B2

(12) United States Patent
Olds et al.

(10) Patent No.: US 9,694,934 B2
(45) Date of Patent: Jul. 4, 2017

(54) BULK BIN

(71) Applicant: Inteplast Group, Ltd., Livingston, NJ (US)

(72) Inventors: David Olds, Vanceburg, KY (US); Jacob Brewer, South Shore, KY (US)

(73) Assignee: Inteplast Group Corporation, Livingston, NJ (US)

( * ) Notice: Subject to any disclaimer, the term of this patent is extended or adjusted under 35 U.S.C. 154(b) by 0 days.

(21) Appl. No.: 14/815,616

(22) Filed: Jul. 31, 2015

(65) Prior Publication Data

US 2017/0029163 A1 Feb. 2, 2017

(51) Int. Cl.
*B65D 6/18* (2006.01)
*B65D 25/30* (2006.01)
*B65D 21/08* (2006.01)

(52) U.S. Cl.
CPC ..... *B65D 11/1833* (2013.01); *B65D 21/086* (2013.01); *B65D 25/30* (2013.01)

(58) Field of Classification Search
None
See application file for complete search history.

(56) References Cited

U.S. PATENT DOCUMENTS 1,720,146 A * 7/1929 Reese ..... B65D 5/36 229/108.1
3,525,466 A 8/1970 Robinson
3,526,566 A * 9/1970 McIlvain, Jr. ..... B31B 1/25 229/930
3,791,002 A 2/1974 Lampe et al.
4,089,417 A 5/1978 Osborne
4,105,153 A 8/1978 Locke
4,119,266 A 10/1978 Dempster
4,131,228 A 12/1978 Barry
4,289,268 A * 9/1981 Paige ..... B65D 5/3621 229/117
4,386,729 A 6/1983 Schmidt
4,441,649 A 4/1984 Nederveld
5,000,372 A 3/1991 Hollander et al.
5,145,110 A * 9/1992 Terpstra ..... B65D 5/10 229/155
5,459,690 A * 10/1995 Rieger ..... G11C 29/781 365/200
5,485,951 A 1/1996 Phillips
6,364,200 B1 4/2002 Moss et al.
6,371,363 B1 4/2002 Franklin et al.
(Continued)

*Primary Examiner* — Christopher Demeree
(74) *Attorney, Agent, or Firm* — Senniger Powers LLP

(57) ABSTRACT

A bulk bin has a perimeter wall and first and second floor panels hingedly joined to the perimeter wall. Each floor panel is selectively foldable from a stowed position to a deployed position. In some embodiments, the first floor panel has a first tab and a first hole and the second floor panel has a second tab and a second hole. The first tab is configured for being selectively received in the second hole for interlocking engagement with the second floor panel, and the second tab is configured for being selectively received in the first hole for interlocking engagement with the first floor panel to secure the first and second floor panels in the deployed position. In certain embodiments, the perimeter wall includes multiple wall portions foldably joined together. At least two of the wall portions are joined at a fold joint of at least three spaced apart vertical creases.

21 Claims, 12 Drawing Sheets

(56) References Cited

U.S. PATENT DOCUMENTS

| | | | | |
|---|---|---|---|---|
| 6,386,437 | B1 | 5/2002 | Larson, Jr. | |
| 6,688,514 | B2 | 2/2004 | Evans et al. | |
| 7,278,565 | B2 * | 10/2007 | West | B65D 5/103 229/109 |
| 7,654,440 | B2 | 2/2010 | Quaintance et al. | |
| 2007/0075124 | A1 * | 4/2007 | McClure | B65D 5/029 229/125.35 |
| 2012/0152799 | A1 | 6/2012 | Ficker | |
| 2014/0209667 | A1 * | 7/2014 | Wood | B65D 5/4279 229/117.16 |

* cited by examiner

BULK BIN

FIELD

The present invention generally relates to bulk bins and more particularly to selectively collapsible bulk bins for storage when in disuse.

BACKGROUND

Bulk bins, which are sometimes referred to as bulk boxes, Gaylord bins, skid boxes, pallet boxes, octabins, etc., are commonly used for storing and shipping bulk quantities of goods. Typically, bulk bins are deployed on pallets so that a forklift can move a bin while it is filled with goods. In a deployed configuration, a bulk bin defines a large interior volume for receiving and containing goods in bulk. Some bulk bins are selectively collapsible for storing the bulk bin in a more space-efficient manner when it is not being used. Conventional collapsible bulk bins are typically made from corrugated paper or corrugated plastic. Paper bins have limited application because they degrade in damp conditions. Conventional corrugated plastic bins can be difficult to pack away flat because of the elastic memory of the material and the large thicknesses required to form bin walls of sufficient strength, which makes them difficult to fold. Normal use of conventional collapsible bins, which includes such actions as collapsing and redeploying the bin, filling the bin with goods, and emptying the bin, damages the material and limits the useful life. Injection molded bulk bins are stronger but are not typically collapsible.

SUMMARY

In one aspect, a bulk bin comprises a perimeter wall having a bottom edge margin and a top edge margin. The perimeter wall is configured to define a bulk bin interior and includes opposite first and second wall portions. A first floor panel is hingedly joined to the bottom edge margin of the first wall portion of the perimeter wall and a second floor panel is hingedly joined to the bottom edge margin of the second wall portion of the perimeter wall. Each of the first and second floor panels is selectively foldable from a stowed position to a deployed position in which the first and second floor panels extend inward from the first and second wall portions and engage one another to form a floor of the bulk bin. The first floor panel comprises a first tab and a first hole and the second floor panel comprises a second tab and a second hole. The first tab is configured for being selectively received in the second hole for interlocking engagement with the second floor panel, and the second tab is configured for being selectively received in the first hole for interlocking engagement with the first floor panel to secure the first and second floor panels in the deployed position.

In another aspect, a bulk bin comprises a floor. A perimeter wall has a bottom edge margin operatively connected to the floor and a top edge margin spaced apart from the bottom edge margin. The perimeter wall comprises a plurality of wall portions extending around the perimeter wall. The plurality of wall portions define a bulk bin interior. The plurality of wall portions are connected to one another by fold joints for being selectively folded between a stowed configuration in which the bulk bin interior has a first volume and a deployed configuration in which the bulk bin interior has a second volume larger than the first volume. First and second adjacent wall portions are connected at a first one of the fold joints. The first fold joint comprises three spaced apart creases formed in the perimeter wall and extending from the bottom edge margin to the top edge margin of the perimeter wall. Other objects and features will be in part apparent and in part pointed out hereinafter.

BRIEF DESCRIPTION OF THE DRAWINGS

Corresponding reference characters indicate corresponding parts throughout the drawings.

DETAILED DESCRIPTION

Figure 1:
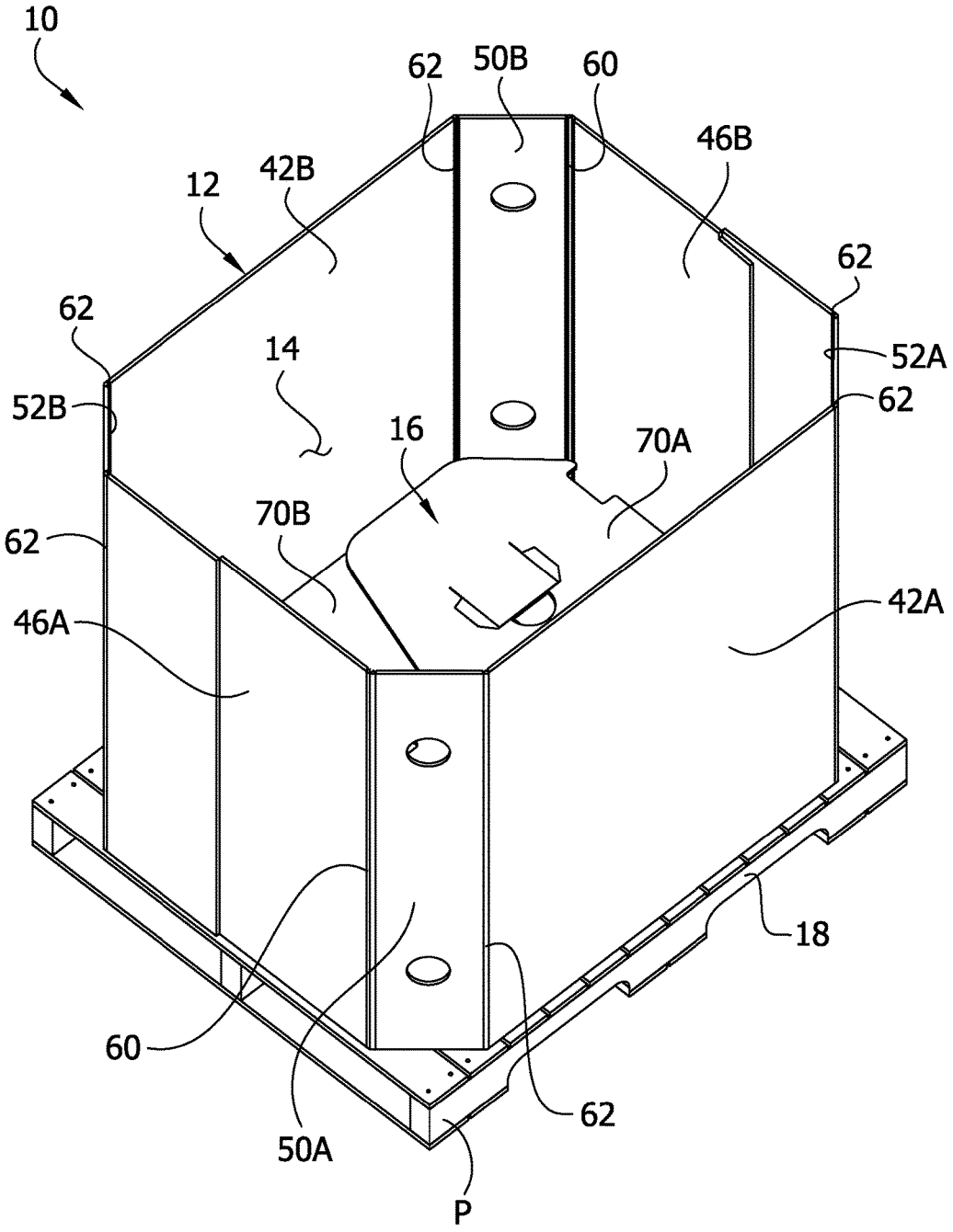
FIG. 1 is a perspective of a bulk bin in a deployed configuration supported on a pallet.

Referring to FIG. 1, a bulk bin in a deployed configuration is generally indicated at reference numeral 10. The bulk bin 10 includes a vertically oriented perimeter wall 12 that extends around a bin interior 14. A generally horizontally extending floor 16 of the bin 10 is attached to a bottom edge margin of the perimeter wall 12, slightly spaced apart from the bottom edge of the wall. When deployed, the bottom edge of the perimeter wall 12 rests on a support surface, such as the pallet P, and spaces the floor 16 apart from the underlying support surface. In the illustrated embodiment, the pallet P supports the bin 10 in the deployed configuration for transportation via forklift (not shown). The bin 10 could also be used without the pallet P. A lid (not shown) can be installed over the top edge of the perimeter wall 12 to contain the contents of the deployed bin 10. When the bin is not in use, it can be selectively collapsed to a stowed configuration illustrated in FIG. 2. In the stowed configuration, the bulk bin interior 14 has a first, small volume, which allows the bulk bin 10 to be stored in relatively tight spaces. In the deployed configuration (FIG. 1), the bulk bin interior 14 has a second volume that is much larger than the first volume for receiving large quantities of goods. As will be discussed in further detail below, the bin 10 folds substantially flat in the stowed configuration and can be selectively collapsed and redeployed many times (e.g., at least about 25 times) during the useful life of the bin.

Referring again to FIG. 1, the perimeter wall 12 of the bin 10 is formed from one or more boards arranged to extend substantially continuously around the circumference of the bin interior 14. The perimeter wall 12 extends vertically from the bottom edge margin to a top edge margin that is spaced apart from the bottom edge margin. In a preferred embodiment, the perimeter wall 12 is made from plastic board material. Other materials may also be used without departing from the scope of the invention including, without limitation, fiberboard, paper, etc. In certain embodiments, the perimeter wall 12 is constructed from two or more separately joined wall members. One-piece perimeter walls can also be used without departing from the scope of the invention. After the perimeter wall 12 is assembled or otherwise formed, the wall is folded to selectively shape the wall in the deployed and stowed configurations. If multiple wall boards are used, the boards can be modified (e.g., creased) to facilitate folding prior to being joined together.

Figure 3:
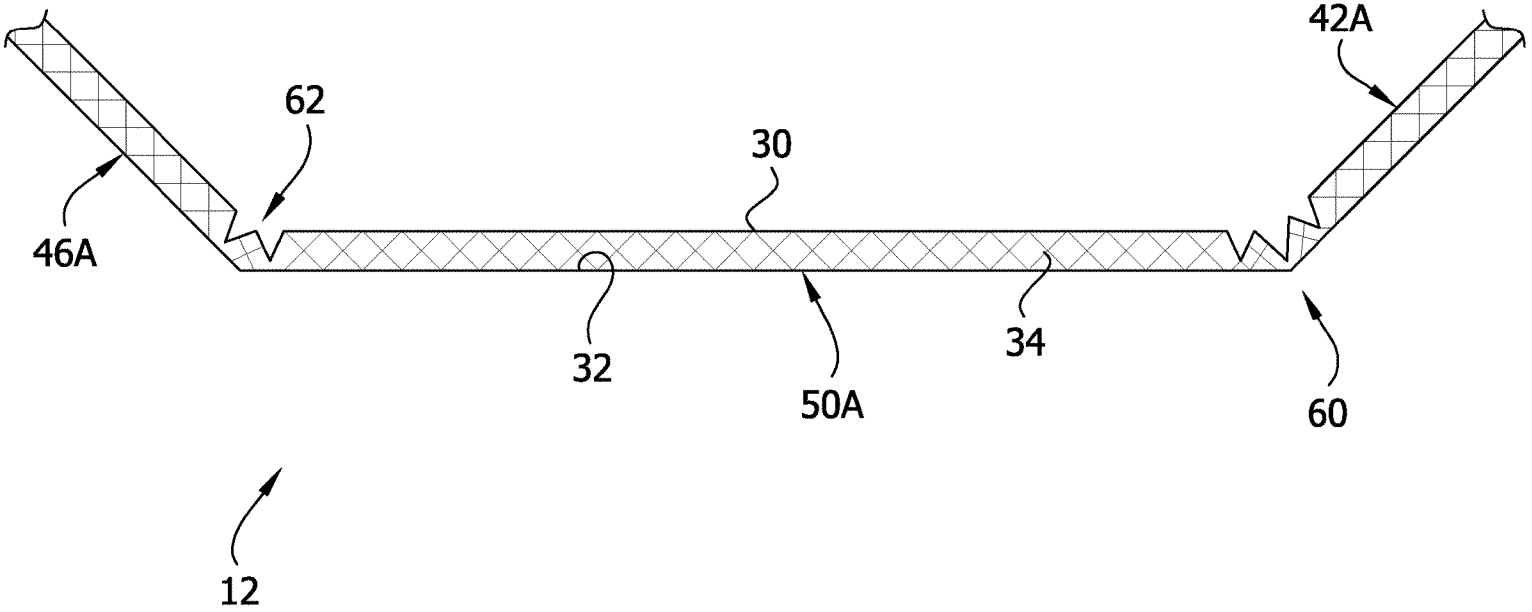
FIG. 3 is an enlarged fragmentary elevation of a portion of a perimeter wall of the bulk bin in the deployed configuration.

In a preferred embodiment, the board material used for the perimeter wall 12 is a plastic cellular material. The top and bottom edge margins of the perimeter wall 12 may be sealed and/or covered with a reinforcing material for added strength. Referring to FIG. 3, in one embodiment, the perimeter wall 12 comprises an inner plastic sheet 30, an outer plastic sheet 32, and a cellular structure 34 extending between the two sheets to space them apart. One preferred example of this type of plastic cellular material is described in International Patent Application Publication No. WO2008/141688 A2. Other types of plastic cellular materials can also be used without departing from the scope of the invention. Likewise, board(s) of other than plastic cellular material may be used to form the perimeter wall 12 without departing from the scope of the invention.

Figure 4:
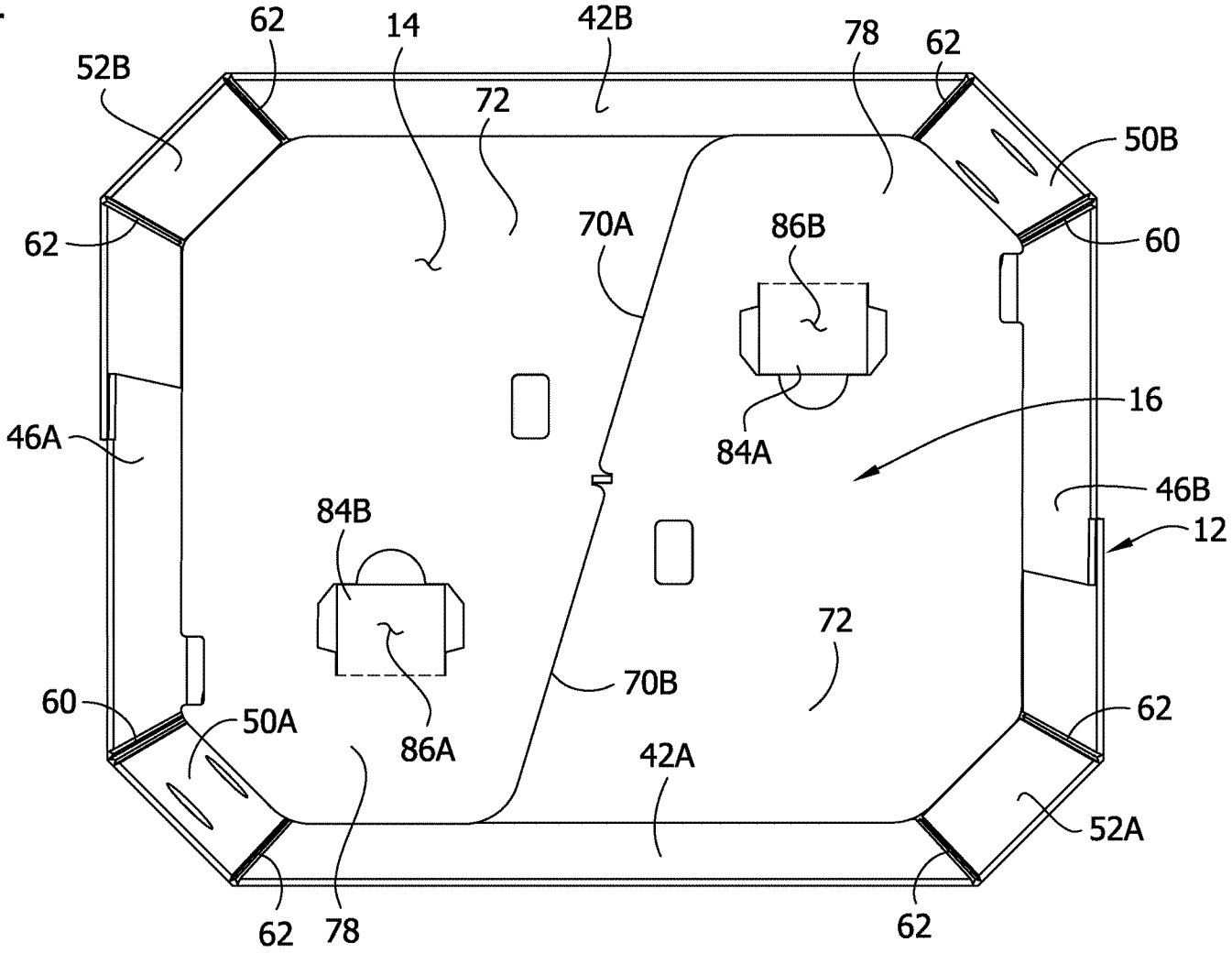
FIG. 4 is a perspective of the bulk bin from a top vantage in the deployed configuration.

Referring to FIG. 4, in the deployed configuration, the perimeter wall 12 is folded to have a generally rectangular cross-sectional shape. The wall 12 includes a first side wall portion 42A and an opposite second side wall portion 42B that define opposite sides of the bin 10 in the deployed position. The wall 14 also includes a first end wall portion 46A and an opposite second end wall portion 46B that extend generally perpendicular to the side wall portions 42A, 42B in the illustrated embodiment and define opposite ends of the bin 10 in the deployed position. In certain embodiments, the side wall portions 42A, 42B and the end wall portions 46A, 46B have about the same width, but in other embodiments they can have different widths without departing from the scope of the invention. As will be discussed in further detail below, the floor 16 is hingedly joined to the first and second side wall portions 42A, 42B and supported thereby. In other embodiments, the floor is hingedly joined to the end wall portions instead of the side wall portions.

In the illustrated embodiment, the corners of the perimeter wall 12 are truncated in the deployed configuration. Four corner wall portions 50A, 50B, 52A, 52B that, in the deployed configuration, are located at the four corners of the bin 10 extend between adjacent ones of the side wall portions 42A, 42B and end wall portions 46A, 46B. The corner wall portions 50A, 50B, 52A, 52B have about the same width, which is less than the width of the side wall portions 42A, 42B and the end wall portions 46A, 46B. In the deployed configuration, the corner wall portions 50A, 50B, 52A, 52B are oriented at non-perpendicular angles relative to the side wall portions 42A, 42B and end wall portions 46A, 46B, truncating the corners of the bin 10. Each of the corner wall portions is oriented at about the same angle relative to the adjacent side wall portions 42A, 42B and end wall portions 46A, 46B in the deployed position. But as this specification describes hereinafter, the corner wall portions 50A, 50B and corner wall portions 52A, 52B are joined to the end wall portions 46A, 46B in different ways to facilitate folding the perimeter wall 12 to the stowed configuration. Although the illustrated bin 10 includes a perimeter wall 12 that has a generally rectangular shape with truncated corners in the deployed configuration, it will be understood that bin perimeter walls can have other constructions without departing from the scope of the invention. For example, the corner wall portions could be omitted so that perimeter wall includes only four hingedly joined wall portions to define the sides and ends of the bin. Still other perimeter wall shapes are also possible.

The wall portions of the perimeter wall 12 are hingedly connected to one another at fold joints 60, 62 for selectively folding the bin 10 between the deployed and stowed configurations. Each of the fold joints 60, 62 extends from the bottom edge margin to the top edge margin of the perimeter wall 12 between a corner wall portion 50A, 50A, 52A, 52B and an adjacent one of the side wall portions 42A, 42B and end wall portions 46A, 46B. In the illustrated embodiment, the perimeter wall 12 defines a total of eight fold joints 60, 62. But where the bin has a different perimeter shape, the perimeter wall can include other numbers of fold joints for hingedly connecting the wall portions without departing from the scope of the invention.

In the illustrated embodiment, two types of fold joints 60, 62 connect the corner wall portions 50A, 50A, 52A, 52B to the adjacent side wall portions 42A, 42B and end wall portions 46A, 46B. As shown, for example, in FIG. 3, fold joints 60 of the first type comprise three spaced apart creases formed in the perimeter wall 12 that extend from the bottom edge margin to the top edge margin. More than three creases can also be used for the fold joints 60 without departing from the scope of the invention. The second type of fold joints 62 preferably include fewer than three creases formed in the perimeter wall 12 that extend from the bottom edge margin to the top edge margin. In the illustrated embodiment, each of the fold joints 62 includes exactly two creases. Along each crease of the fold joints 60, 62 the inner plastic sheet 30 extends inward in the cellular core 34 of the wall 12, thereby crushing the cellular structure at the crease. For both types of fold joints 60, 62, each crease is V-shaped in cross-section. Other crease shapes may also be used without departing from the scope of the invention.

The creases may be formed, for example, using a crease folding machine such as the Wegener Welding Crease-Folding Machine Model ESP 2000, available from Wegener Welding LLC in Burr Ridge, Ill. Suitable crease folding machines include a maximum of two crease-forming members that the machine drives against a board to form a pair of spaced apart V-shaped creases (i.e., a 'VV' pattern). Thus, a crease-folding machine can fold the double-crease fold joints 62 in a single operation. In order to form each triple-crease fold joint 60, the folding machine is operated twice. The machine initially forms two creases in a 'VV' pattern. Then the board is reloaded into the crease folding machine so that one of the machine's crease-forming members is substantially aligned with one of the previous V-shaped creases and the other crease-forming member is spaced apart from the two existing creases. As the machine drives the crease-forming members against the board, one of the crease-forming members forms a third V-shaped crease and the other reenters the middle one of the creases formed previously. The resulting triple-crease joint 60 has a 'VVV' pattern.

Figure 3A:
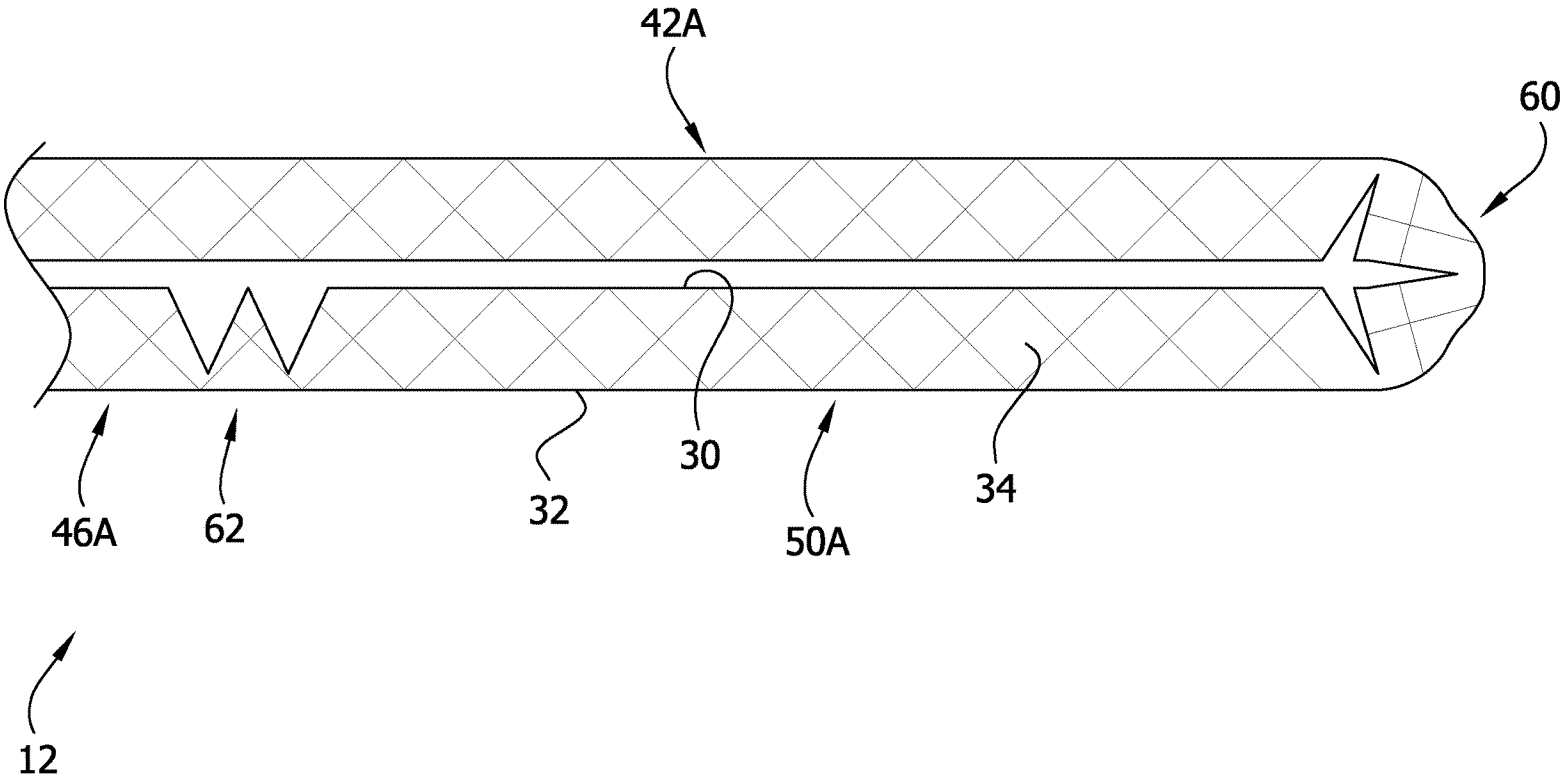
FIG. 3A is an enlarged fragmentary elevation of a portion of the perimeter wall in the stowed configuration.
Figure 3B:
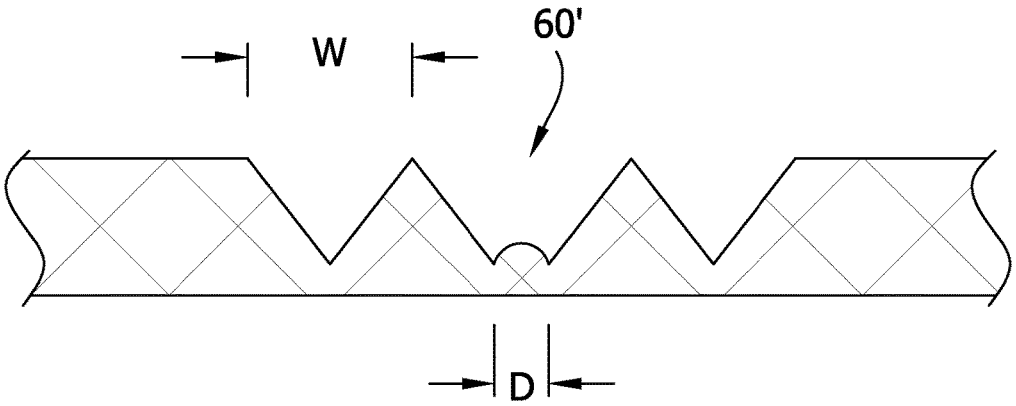
FIG. 3B is an enlarged fragmentary elevation of a portion of another perimeter wall being laid flat along a triple-crease fold joint.
Figure 3C:
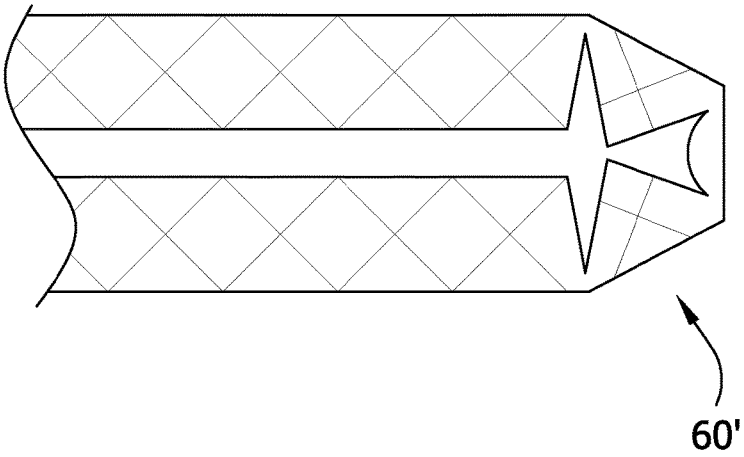
FIG. 3C is an enlarged fragmentary elevation of the perimeter wall of FIG. 3B with the perimeter wall being folded closed.

In another embodiment illustrated in FIGS. 3B and 3C, the triple-crease fold joint 60' has a slightly different configuration. FIG. 3B illustrates the triple-crease fold joint 60' opened such that the board is laid flat, which is not a configuration that the perimeter wall 12 would be in during use. However, the laid flat configuration helps illustrate the differences between the triple-crease fold joint 60' and the fold joint 60. Like the triple-crease fold joint 60, the triple-crease fold joint 60' can be formed by loading a board into the crease-folding machine two times. Instead of reloading the board so that one of the crease-forming members is substantially aligned with a previously formed crease, the board is reloaded so that one of the crease-forming members is oriented parallel and slightly spaced apart from the previously formed crease. In the illustrated embodiment, the board is reloaded so that the crease-forming member is spaced apart from the previously formed crease an offset distance D. The resulting triple-crease fold joint 60' is wider than the triple crease fold joint 60. The center crease of the fold joint 60' has an enlarged V-shape with a small bump that protrudes outward at the base of the crease and extends widthwise along the offset distance D1. In one or more preferred embodiments, the offset distance D1 is from about 0% to about 75% of a width W of the wide end of each V-shaped crease. For example, the offset distance D1 is from about 0% to about 50% of the width W in certain embodiments. As shown in FIG. 3C, it the wider center crease can facilitate flatly folding thicker boards over upon themselves by facilitating folding at the end crease 60' with less deformation of the material of the board.

Figure 2:
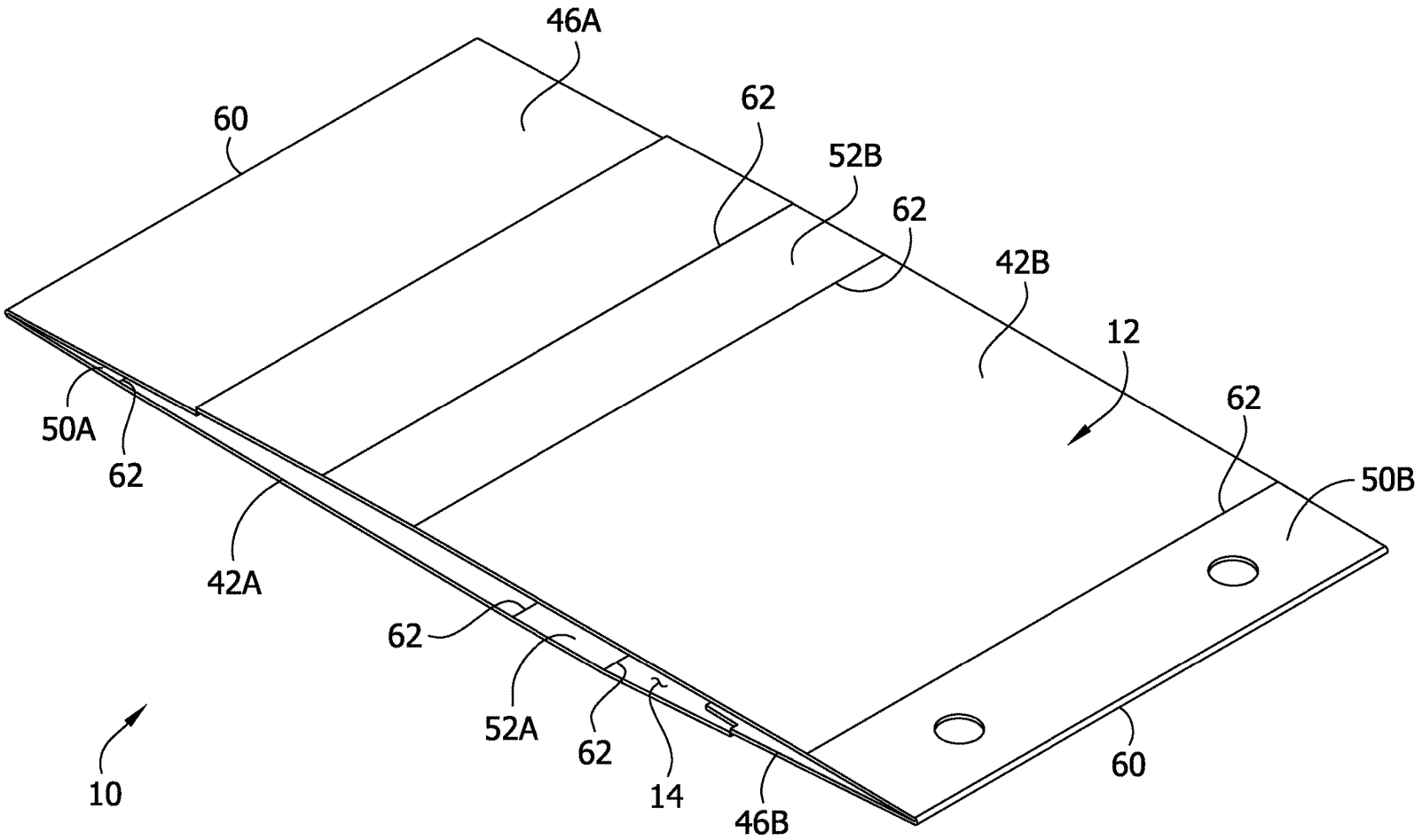
FIG. 2 is a perspective of the bulk bin in a stowed configuration.
Figure 5:
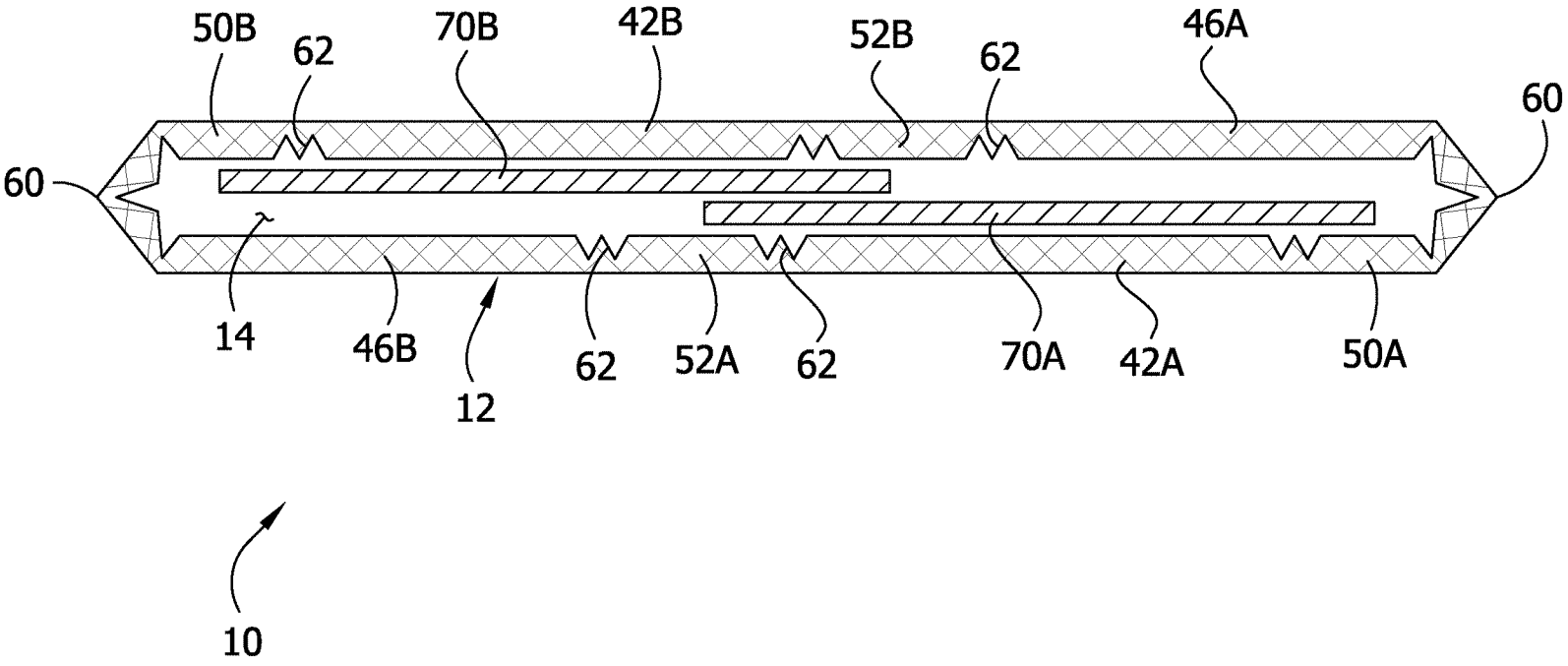
FIG. 5 is an elevation of the bulk bin in the stowed configuration.

The corner wall portions 50A, 50B are joined to respective end wall portions 46A, 46B at the triple-crease fold joints 60 to facilitate flattening the perimeter wall 12 in the stowed configuration. As shown in FIGS. 2, 3A, and 5, each triple-crease fold joint 60 forms a folded edge of the perimeter wall 12 in the stowed configuration. When the bin 10 is in the stowed configuration, two of the corner wall portions 50A, 50B are positioned along the folded edges of the stowed bin and the other two corner wall portions 52A, 52B are positioned roughly midway between the folded edges. One of the triple-crease fold joints 60 hingedly connects a first one of the corner wall portions 50A and the first end wall portion 46A; the other of the triple crease fold joints 60 hingedly connects a second one of the corner wall portions 50B and the second end wall portion 46B. When the bin 10 is in the stowed configuration, the perimeter wall 12 folds around the fold joint 60 so that a first corner wall portion 50A and the first end wall portion 46A are oriented generally parallel to one another in a stack adjacent the folded edge of the bin 10. The opposite fold joint 60 folds the perimeter wall 12 so the second corner wall portion 50B and the second end wall portion 46B are oriented generally parallel to one another in a stack adjacent the opposite folded edge of the bin. In the stowed configuration, the fold joints 62 open so that the first corner wall portion 50A, the first side wall portion 42A, a third one of the corner wall portions 52A, and the second end wall portion 46B are arranged in a first substantially planar sheet. The second corner wall portion 50B, the second side wall portion 42B, a fourth one of the corner wall portions 52B, and the first end wall portion 46A are arranged in a second substantially planar sheet, which is stacked flatly with the first substantially planar sheet of wall portions. As can be seen, the triple-crease joints allow the plastic material of the perimeter wall 12 to fold tightly back on itself tightly along three closely spaced apart fold lines. As a result, the perimeter wall 12 does not bulge out at opposite ends and the wall portions can be stacked flatly in two substantially planar sheets in the stowed configuration.

Figure 4A:
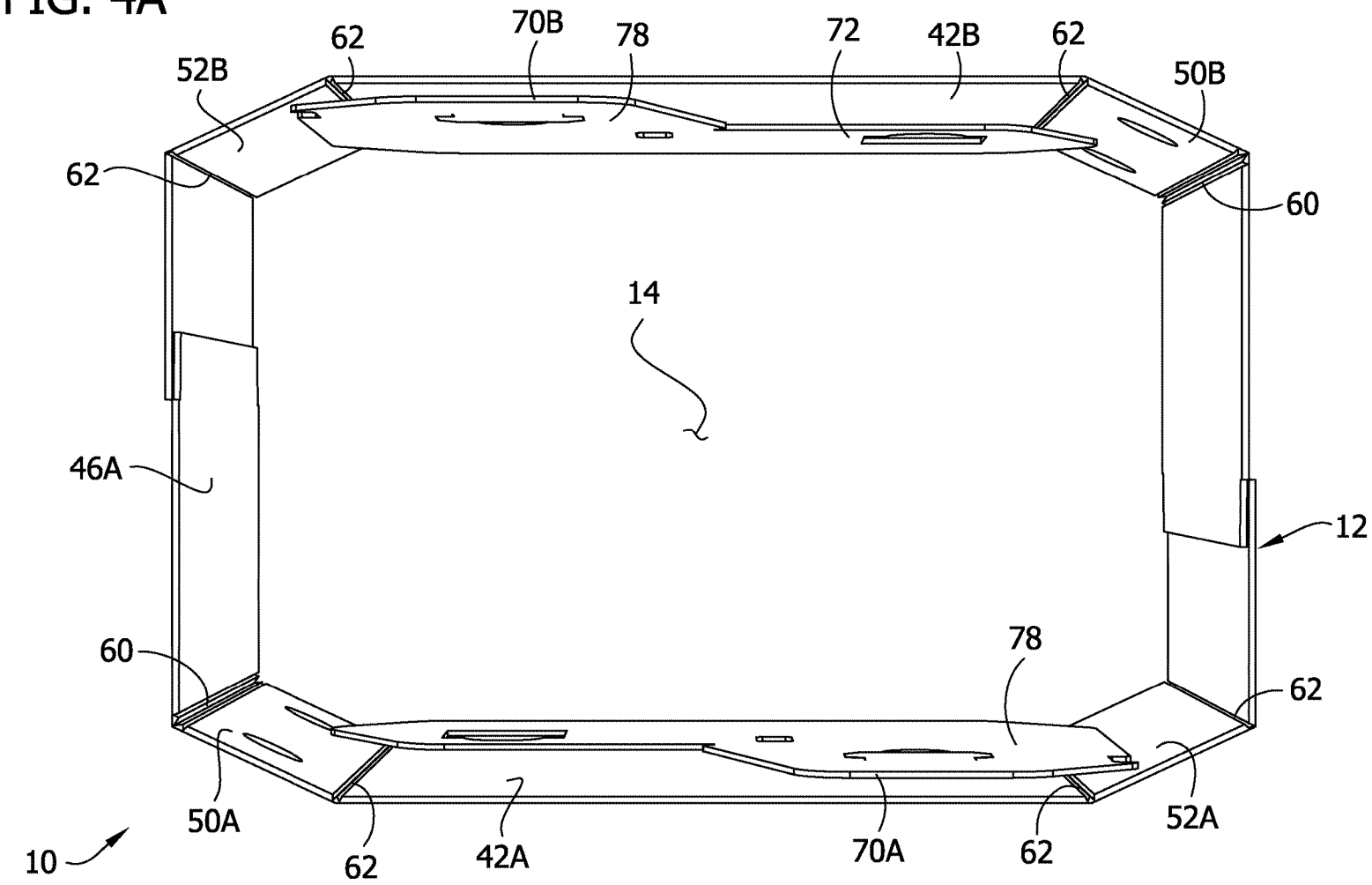
FIG. 4A is similar to FIG. 4, illustrating floor panels of the bulk bin folded toward a stowed position.
Figure 6:
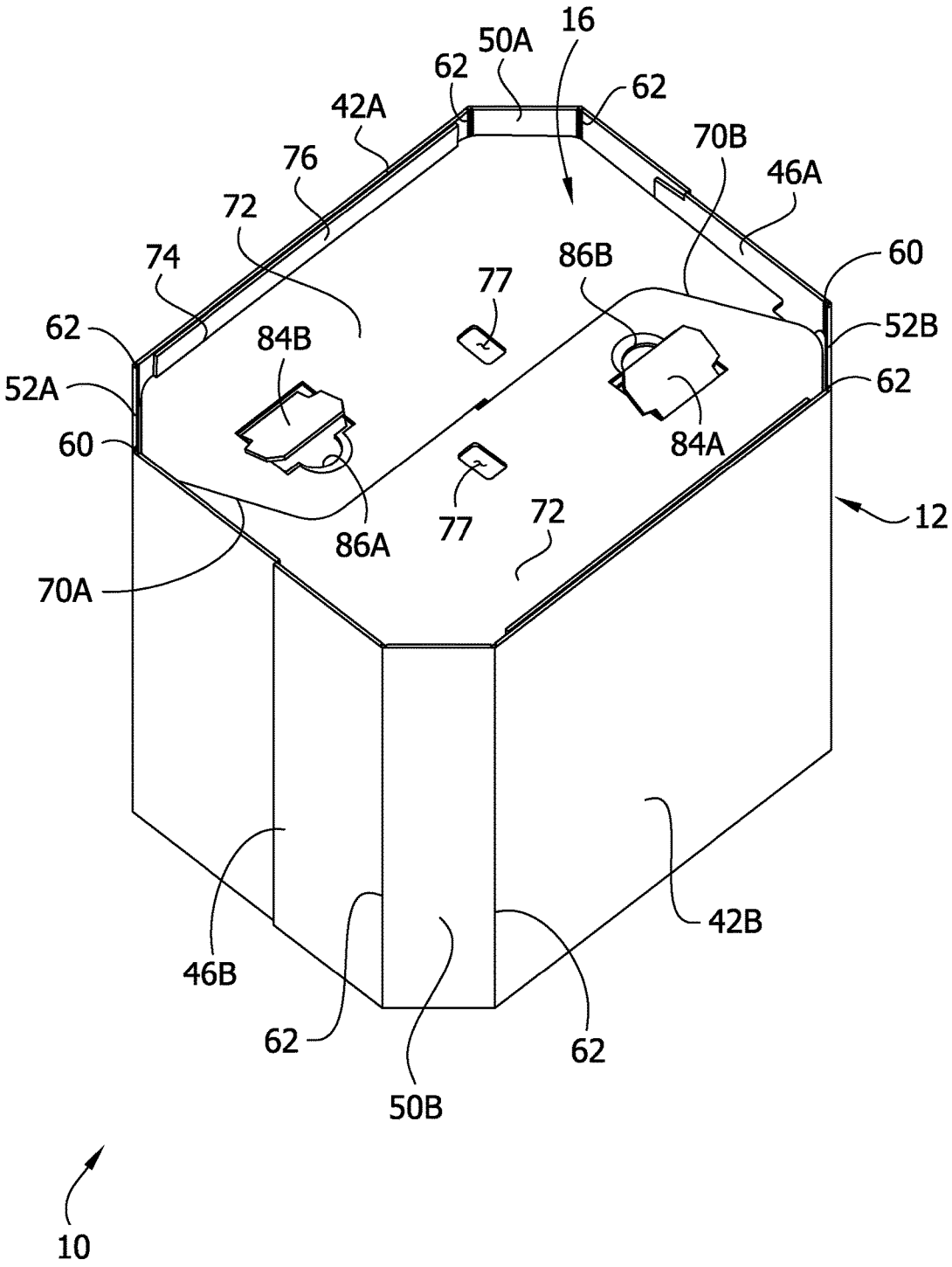
FIG. 6 is a perspective of the bulk bin from a bottom vantage in the deployed configuration.
Figure 7:
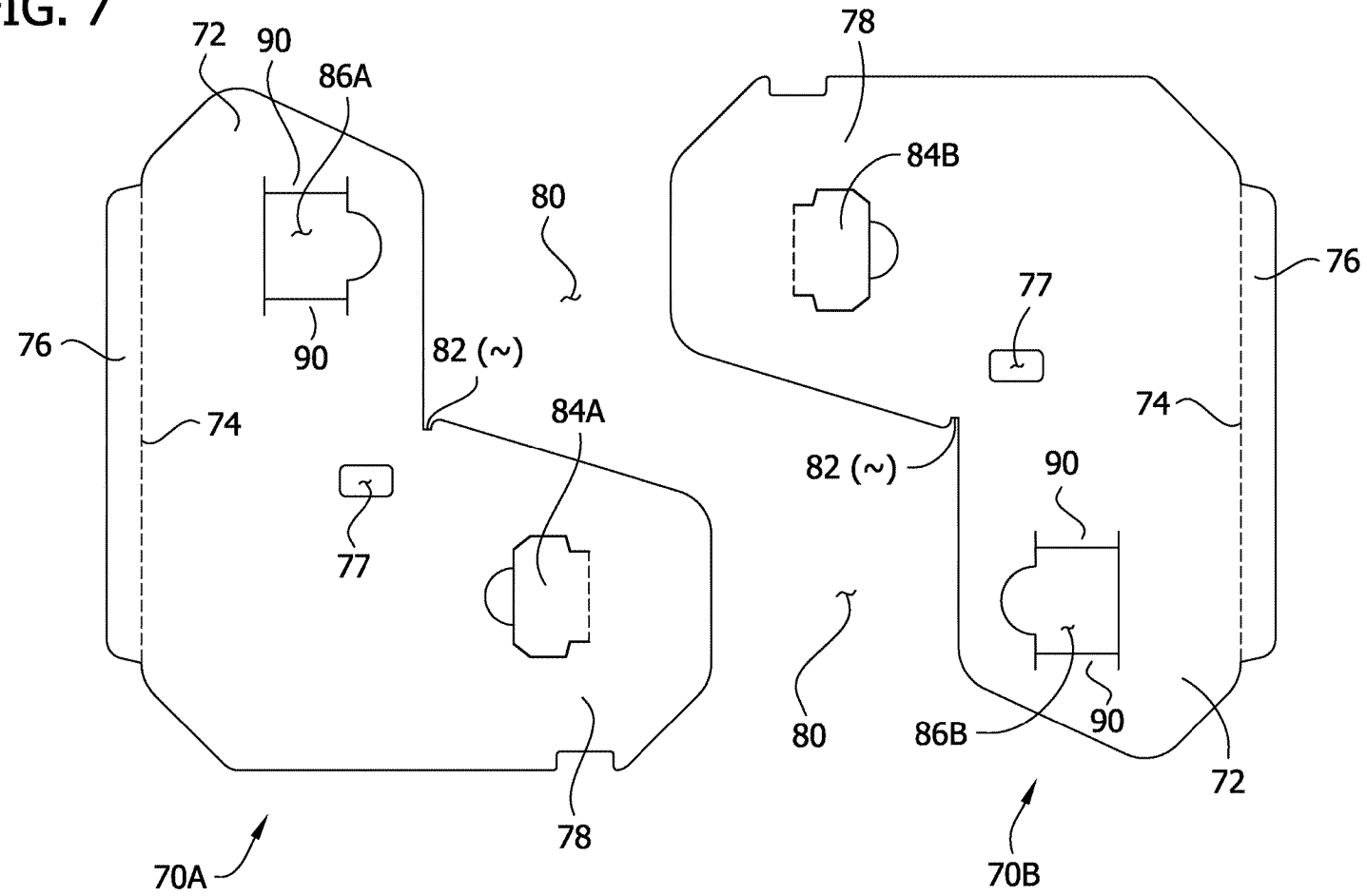
FIG. 7 is a separated plan view of the floor panels.

Referring again to FIG. 4 and also to FIGS. 6 and 7, the floor 16 includes a first floor panel 70A and a second floor panel 70B that are configured for complementary interlocking engagement with one another. The first floor panel 70A is hingedly joined to the bottom edge margin of the first side wall portion 42A, and the second floor panel 70B is hingedly joined to bottom edge margin of the second side wall portion 42B. In a preferred embodiment, the floor panels 70A, 70B are respectively made of a fluted plastic material and welded to the perimeter wall 12. But in other embodiments, the floor panels could be made from other materials or hingedly joined to the perimeter wall in other ways without departing from the scope of the invention. As shown in FIGS. 4 and 4A and as will be discussed in further detail below, each of the first and second floor panels 70A, 70B is selectively foldable from a stowed position (FIG. 4A) to a deployed position (FIG. 4) in which the first and second floor panels extend inward from the side wall portions 42A, 42B to form the bin floor 16. In the illustrated embodiment, the first and second floor panels 70A, 70B fold inward into the bulk bin interior 14 in the stowed position, as illustrated in FIG. 4A. In other embodiments, it is contemplated that the floor panels 70A, 70B could fold outward in the stowed position such that a large portion of each floor panel extends out of the bin interior 14.

Figure 4B:
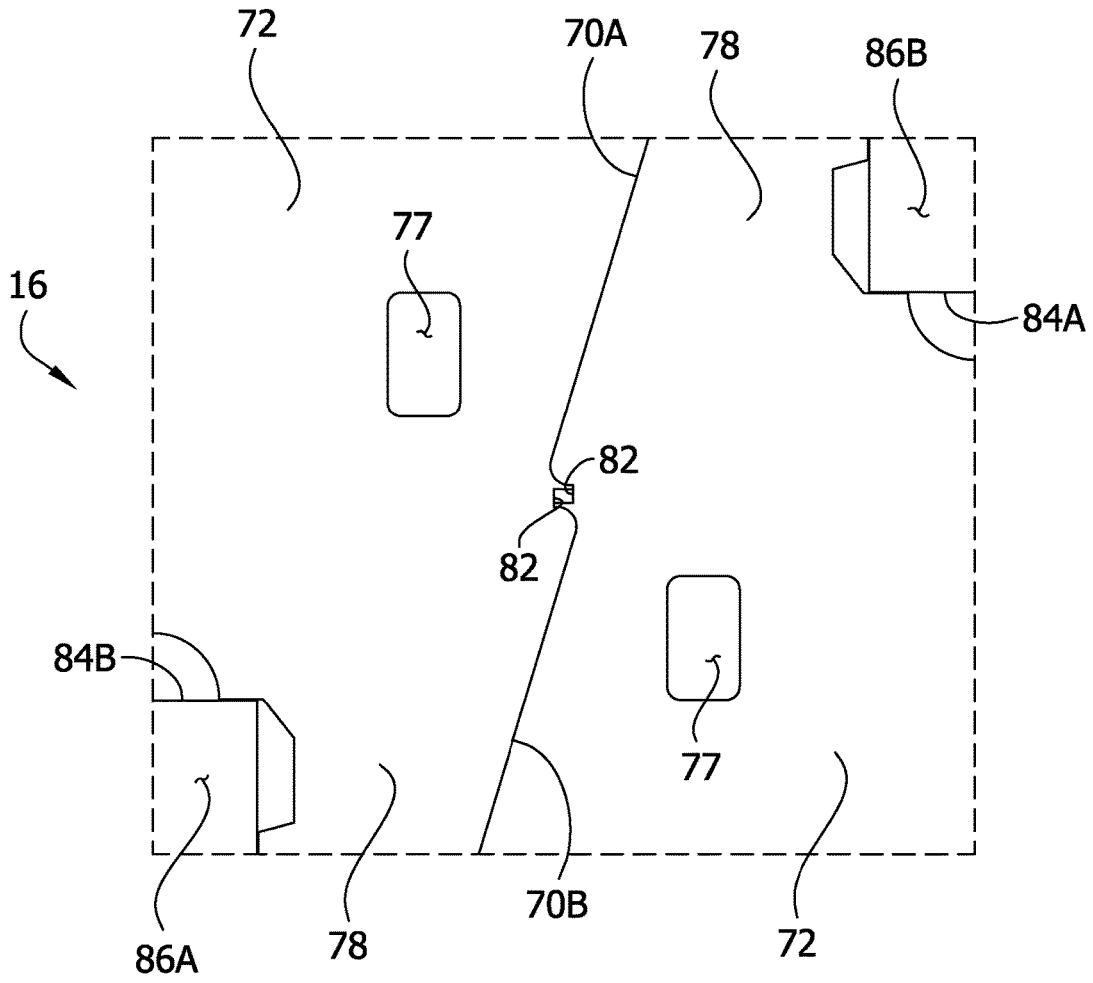
FIG. 4B is an enlarged view of a portion of FIG. 4.

As shown in FIGS. 4, 6, and 7, each of the floor panels 70A, 70B has a substantially identical construction, shaped and arranged for complementary engagement with the other of the floor panels for securing the floor 16 in the deployed position. Each floor panel 70A, 70B has a base portion 72 extending inward from the respective one of the first and second side wall portions 42A, 42B. A fold joint 74 hingedly connects the base portion 72 to an attachment strip 76, which is joined to the respective side wall portion 42A, 42B and extends away from the fold joint along the side wall portion toward the bottom edge of the perimeter wall 12. Each floor panel 70A, 70B includes a hand hole 77 positioned for grasping to manipulate the floor panel between the stowed and deployed positions (e.g., by folding the floor panel along the fold joint 74). Each of the floor panels 70A, 70B further includes a flap portion 78 that projects inward from the base portion 72. The flap portion 78 of each floor panel 70A, 70B defines a notch 82. In the deployed position, the flap portion 78 of each of the floor panels 70A, 70B is secured in overlapping engagement with of the base portion 72 of the other floor panel. In the illustrated embodiment, the flap portion 78 of each floor panel 70A, 70B overlies the base portion 72 in the deployed position. But in other embodiments, the flap portion underlies the base portion. As shown in FIG. 4B, an edge portion of the flap 78 of the first floor panel 70A is received in the notch 82 of the second floor panel 70B and an edge portion of the flap of the second floor panel is received in the notch of the first floor panel to stabilize the floor panels in the deployed position. Although the illustrated embodiment uses floor panels 70A, 70B that have a base portion 72 and projecting flap portion 78, it will be understood that other bulk bins can have floor panels of different shapes without departing from the scope of the invention.

The floor panels 70A, 70B are configured to be selectively and repeatedly folded between the stowed and deployed positions many times (e.g., at least about 25 times) without materially damaging the bin 10. As discussed above, the floor panels 70A, 70B are preferably formed of fluted plastic material. Referring to FIG. 4, in one embodiment, the flutes in the fluted panels 70A, 70B are oriented generally parallel (e.g., less than about 15° from parallel) with the end wall portions 46A, 46B. The fold joints 74 along which the floor panels 70A, 70B fold between the stowed and deployed position are oriented transverse to the flutes. Preferably the fluted material is modified (e.g., with scoring, etc.) to fold compliantly along the fold joints 74. The modified fold joints 74 improve the robustness of the floor panels 70A, 70B when being folded between the stowed and deployed positions.

Each of the first and second floor panels 70A, 70B is configured to interlockingly engage the other of the floor panels to secure the floor panels in the deployed position. The first floor panel 70A comprises a first tab 84A and a first hole 86A, and the second floor panel 70B comprises a second tab 84B and a second hole 86B. In the illustrated embodiment, the first and second tabs 84A, 84B are hingedly joined to the flap portion 78 of the respective one of the first and second floor panels 70A, 70B, and the first and second holes 86A, 86B are formed in the base portion 72 of the respective one of the first and second floor panels. The flap portion 78 and tab 84A of the first floor panel 70A are located adjacent the first end wall portion 46A, and the flap portion and tab 84B of the second floor panel 70B are located adjacent the second end wall portion 46B. The first hole 86A is formed in the base portion 72 of the first floor member 70A adjacent the second end wall portion 46B in positional alignment with the second tab 84B when the floor 16 is in the deployed position. The second hole 86B is formed in the base portion 72 of the second floor member 70B adjacent the first end wall portion 46A in positional alignment with the first tab 84A when the floor 16 is in the deployed position. The first tab 84A is configured for being selectively received in the second hole 86B for interlocking engagement with the base portion 72 of the second floor panel 70B and the second tab 84B is configured for being selectively received in the first hole 86A for interlocking engagement with the base portion of the first floor panel 70A. The engagement between the tabs 84A, 86B and the base portions 72 of the respective floor panels 70A, 70B secures the floor 16 in the deployed position.

Figure 7A:
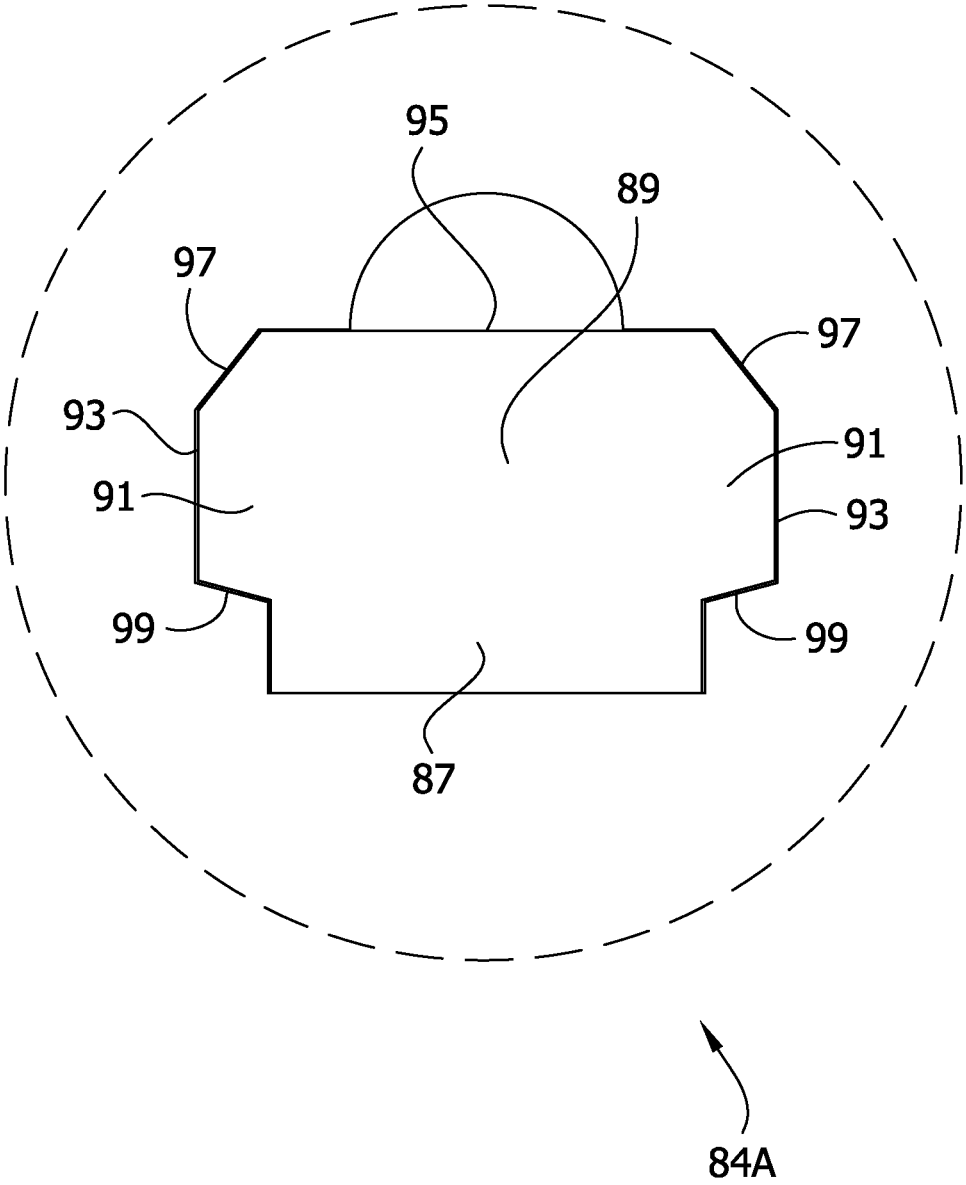
FIG. 7A is an enlarged view of a portion of FIG. 7.

The tabs 84A, 84B are configured to be selectively and repeatedly received in and removed from the holes 86A, 86B (e.g., at least about 25 times) without materially damaging the bin 10. As shown in FIG. 7A, each tab 84A, 84B in the illustrated embodiment is a three-sided cutout in the respective flap portion 78 defining a narrow neck portion 87 adjacent a fold joint and a wider interlocking portion 89 toward the free end of the tab. Wing portions 91 of the interlocking portion 89 of each tab 84A, 84B extend outward from the neck portion 87 and define side edges 93 that are oriented substantially parallel to the side edges of the corresponding hole 86A, 86B when the tabs are received in the holes. A free end edge 95 is oriented generally perpendicular to the side edges 93 of the wing portions 91. Preferably, the wing portions 91 define angled outer corner edges 97 oriented at a non-perpendicular angle relative to the free end edge 95. In one or more embodiments, the angled outer corner edges 97 are oriented at an angle of from about 15° to about 60° to the free end edge 95. The angled outer corner edges 97 help facilitate inserting the tabs 84A, 84B through the respective holes 86A, 86B by more gradually bending the wing portions 91 away from their planar orientation as the tabs pass through the holes. The wing portions 91 likewise define angled inner corner edges 99 oriented at a non-perpendicular angle relative to the free end edge 95. In one or more embodiments, the angled inner corner edges 99 are oriented at an angle of from about 15° to about 60° to the free end edge 95. Like the outer angled corner edges 97, the angled inner corner edges 99 help facilitate pushing the tabs 84A, 84B through the respective holes 86A, 86B when removing the tabs by more gradually bending the wing portions 91 away from their planar orientation as the tabs pass through the holes to break down the bin 10.

Referring again to Figs. FIGS. 4, 6, and 7, in addition to the three-sided tab cutout, a portion of the panel 70A, 70B just past the free end of each tab 84A, 84B (which is semicircular in the illustrated embodiment) is cut away to provide a space for grasping and manipulating the tab in use. A corresponding semicircular cutout is also formed in the panels 70A, 70B adjoining the holes 86A, 86B. In certain embodiments, the fold joints of the tabs 84A, 84B are defined by heat score lines along the flap material. The interlocking portion of each tab 84A, 84B is wider than the receiving hole 86A, 86B. In embodiments in which the floor panels 70A, 70B are made from fluted plastic, each tab 84A, 84B is preferably oriented so that interlocking portion of the tab bends along hollow flutes as the tab deflects against the base portion and passes through the receiving hole 86A, 86B. Folding along the hollow flutes facilitates resilient, non-destructive bending of the tab 84A, 84B so that the tab can be reused. Thus, the portions of the tabs 84A, 84B that bend as they pass through the openings 86A, 86B move back once through the openings to block withdrawal of the tabs from the openings.

As illustrated in FIG. 7, in some embodiments, the floor panels 70A, 70B are slit to define resiliently bendable flaps 90 one or both sides of the holes 86A, 86B. The flaps 90 engage the wing portions of the tabs 84A, 84B and bend inward as the tabs are being pulled through the holes to permit reuse of the floor panels 70A, 70B with limited damage. In one or more embodiment the slits defining the flaps 90 extend from about 0.25 inches to about 0.75 inches from the side edges of the holes 86A, 86B.

When the floor panels 70A, 70B are in the deployed position, the tabs 84A, 84B secured in receiving holes 86A, 86B, and the bin interior 14 is filled with goods, the center of the floor 16 may sag such that the bottom of the floor rests against the underlying support surface. The floor panels 70A, 70B are preferably arranged so that the tabs 84A, 84B slide in the holes 86A, 86B without disengaging as the floor 16 sags.

A suitable method of using the bin 10 will now be briefly described. A bin user typically receives the bulk bin 10 in the stowed configuration. When the user wants to store goods in the bin 10, the user folds the bin from the stowed configuration (FIG. 2) to the deployed configuration (FIG. 1). The user unfolds the perimeter wall 12 so that the wall has a generally rectangular shape with truncated corners. With the perimeter wall 12 in the deployed configuration, the user uses the hand holes 77 to grasp the floor panels 70A, 70B and fold them to the deployed position, where the flap portion 78 of the first floor panel overlies the base portion 72 of the second floor panel and the flap portion of the second floor panel overlies the base portion of the first floor panel. Then the user reaches through the semicircular cutouts adjoining the tabs 84A, 84B and holes 86A, 86B and pulls the first tab 84A through the second hole 86B and the second tab 84B through the first hole 86A to interlockingly engage the tabs with the base portions 72 of the floor panels 70A, 70B. The interlocking engagement of the tabs 84A, 84B with the base portions 72 of the floor panels 70A, 70B secures the floor 16 in the deployed position. The user may place the deployed bulk bin 10 on a pallet P, load the bin interior 14 with goods, and transport the loaded or unloaded bin using a forklift.

When the bin 10 is no longer needed to hold goods, it can be collapsed to the stowed configuration for storage. The user removes the first tab 84A from the second hole 86B and the second tab 84B from the first hole 86A and folds the floor panels 70A, 70B along the fold joints 74 up to the stowed position (FIG. 4A). Then the user folds the perimeter wall 12 along the triple-crease fold joints 60, flattening the wall portions into two substantially planar sheets along the double-crease fold joints 62. Once collapsed to the stowed configuration, the bulk bin 10 can be stacked with many other stowed bulk bins in a relatively small area.

As can be seen, the illustrated bulk bin 10 can be selectively and repeatedly stowed and deployed. The bin 10 includes triple-crease fold joints 60 that allow the bin to be folded flat in the stowed configuration while being made from strong material that can withstand repeated folding between the stowed and deployed configurations. The floor 16 of the bin 10 uses two floor panels 70A, 70B that fold flat with the perimeter wall 12 in the stowed configuration and selectively interlock to provide a secure floor 16 in the deployed configuration. The hole and tab locking configuration is easy to use and, in at least some embodiments, allows the floor panels 70A, 70B to be repeatedly secured together without materially damaging the bin 10.

Having described the invention in detail, it will be apparent that modifications and variations are possible without departing from the scope of the invention defined in the appended claims.

When introducing elements of the present invention or the preferred embodiments(s) thereof, the articles "a", "an", "the" and "said" are intended to mean that there are one or more of the elements. The terms "comprising", "including" and "having" are intended to be inclusive and mean that there may be additional elements other than the listed elements.

In view of the above, it will be seen that the several objects of the invention are achieved and other advantageous results attained.

As various changes could be made in the above products without departing from the scope of the invention, it is intended that all matter contained in the above description and shown in the accompanying drawings shall be interpreted as illustrative and not in a limiting sense.

What is claimed is:

1. A bulk bin comprising:

a perimeter wall having a bottom edge margin and a top edge margin, the perimeter wall being configured to define a bulk bin interior and including opposite first and second wall portions; and first and second floor panels, the first floor panel being hingedly joined to the bottom edge margin of the first wall portion of the perimeter wall and the second floor panel being hingedly joined to the bottom edge margin of the second wall portion of the perimeter wall, each of the first and second floor panels being selectively foldable from a stowed position to a deployed position in which the first and second floor panels extend inward from the first and second wall portions and engage one another to form a floor of the bulk bin, the first floor panel comprising a first tab and a first hole and the second floor panel comprising a second tab and a second hole, the first tab being configured for being selectively received in the second hole for interlocking engagement with the second floor panel and the second tab being configured for being selectively received in the first hole for interlocking engagement with the first floor panel to secure the first and second floor panels in the deployed position;

wherein the first hole has a perimeter and the first floor panel extends around the entire perimeter of the first hole.

2. A bulk bin as set forth in claim 1 wherein each of the first and second floor panels comprises a base portion extending inward from the respective one of the first and second wall portions and a flap portion extending inward from the base portion.

3. A bulk bin as set forth in claim 2 wherein each of the first and second tabs are hingedly joined to the flap portion of the respective one of the first and second floor panels.

4. A bulk bin as set forth in claim 2 wherein each of the first and second holes are formed in the base portion of the respective one of the first and second floor panels.

5. A bulk bin as set forth in claim 2 wherein the flap portion of the first floor panel overlies the base portion of the second floor panel and the flap portion of the second floor panel overlies the base portion of the first floor panel in the deployed position.

6. A bulk bin as set forth in claim 5 wherein the perimeter wall further comprises opposite third and fourth wall portions, the flap portion of the first floor panel being located adjacent the third wall portion and defining a notch in the first floor panel and the second flap portion being located adjacent the fourth wall portion and defining a notch in the second floor panel.

7. A bulk bin as set forth in claim 6 wherein the flap portion of the first floor panel is shaped and arranged for extending into the notch in the second floor panel and the flap portion of the second floor panel is shaped and arranged for extending into in the first floor panel.

8. A bulk bin as set forth in claim 1 wherein the perimeter wall and the first and second floor panels are formed from a plastic material and the floor panels are welded to the perimeter wall.

9. A bulk bin as set forth in claim 1 further comprising a hand hole in the first floor panel and a hand hole in the second floor panel, the hand hole being positioned for grasping to manipulate the first and second floor panels between the stowed and deployed positions.

10. A bulk bin as set forth in claim 1 wherein the perimeter wall includes at least two fold joints configured for folding the perimeter wall into a low profile collapsed position, each fold joint comprising at least three creases extending from the bottom edge margin to the top edge margin.

11. A bulk bin as set forth in claim 1 wherein the first and second floor panels extend into the bulk bin interior in the stowed position.

12. A bulk bin comprising:

a floor; and a perimeter wall having a bottom edge margin operatively connected to the floor and a top edge margin spaced apart from the bottom edge margin, the perimeter wall comprising a plurality of wall portions extending around the perimeter wall, the plurality of wall portions defining a bulk bin interior, the plurality of wall portions being connected to one another by fold joints for being selectively folded between a stowed configuration in which the bulk bin interior has a first volume and a deployed configuration in which the bulk bin interior has a second volume larger than the first volume, the plurality of wall portions including an end wall portion, a side wall portion, and a corner wall portion extending between the end wall portion and the side wall portion and being connected to each of the end wall portion and the side wall portion at a respective one of a first fold joint and a second fold joint, each of the first and second fold joints comprising one or more creases formed in the perimeter wall and extending from the bottom edge margin to the top edge margin of the perimeter wall, the first fold joint comprising three spaced apart creases and the second fold joint comprising fewer creases than the first fold joint.

13. A bulk bin as set forth in claim 12 wherein each of the creases is V-shaped in cross section.

14. A bulk bin as set forth in claim 12 wherein the perimeter wall is formed from a plastic material.

15. A bulk bin as set forth in claim 12 wherein the floor comprises first and second floor panels hingedly joined to the perimeter wall on opposite sides thereof, the first floor panel comprising a first tab and a first hole and the second floor panel comprising a second tab and a second hole, the first tab being configured for being selectively received in the second hole for interlocking engagement with the second floor panel and the second tab being configured for being selectively received in the first hole for interlocking engagement with the first floor panel.

16. A bulk bin as set forth in claim 12 wherein each of the end wall portion, the side wall portion, and the corner wall portion has a width, the width of the corner wall portion being less than the widths of the end wall portion and the side wall portion.

17. A bulk bin as set forth in claim 12 wherein the end wall portion comprises a first end wall portion and the side wall portion comprises a first side wall portion, the plurality of wall portions further including a second end wall portion opposite the first end wall portion and a second side wall portion opposite the first side wall portion.

18. A bulk bin as set forth in claim 17 wherein the corner wall portion comprises a first corner wall portion, the plurality of wall portions further including a second corner wall portion extending between the first end wall portion and the second side wall portion, a third corner wall portion extending between the second end wall portion and the second side wall portion, and a fourth corner wall portion extending between the second end wall portion and the first side wall portion.

19. A bulk bin as set forth in claim 18 wherein the third corner wall portion is connected to each of the second end wall portion and the second side wall portion at one of a third fold joint comprising three spaced apart creases and a fourth fold joint comprising fewer creases than the third fold joint.

20. A bulk bin as set forth in claim 18 wherein the second corner wall portion is connected to each of the first end wall portion and the second side wall portion at a respective second corner wall portion fold joint and the fourth corner wall portion is connected to each of the second end wall portion and the first side wall portion at a respective fourth corner wall portion fold joint, each of the second corner wall portion fold joints and the fourth corner wall portion fold joints comprising a lesser number of creases than the first fold joint.

21. A bulk bin comprising:

a perimeter wall having a bottom edge margin and a top edge margin, the perimeter wall being configured to define a bulk bin interior and including opposite first and second wall portions; and first and second floor panels, the first floor panel being hingedly joined to the bottom edge margin of the first wall portion of the perimeter wall and the second floor panel being hingedly joined to the bottom edge margin of the second wall portion of the perimeter wall, each of the first and second floor panels being selectively foldable from a stowed position to a deployed position in which the first and second floor panels extend inward from the first and second wall portions and engage one another to form a floor of the bulk bin, each of the first and second floor panels comprising a base portion extending inward from the respective one of the first and second wall portions and a flap portion extending inward from the base portion, the first floor panel comprising a first tab and a first hole formed in the base portion of the first floor panel and the second floor panel comprising a second tab and a second hole formed in the base portion of the second floor panel, the first tab being configured for being selectively received in the second hole for interlocking engagement with the second floor panel and the second tab being configured for being selectively received in the first hole for interlocking engagement with the first floor panel to secure the first and second floor panels in the deployed position.

* * * * *